US011897685B2

(12) United States Patent
O'Brien et al.

(10) Patent No.: US 11,897,685 B2
(45) Date of Patent: Feb. 13, 2024

(54) TABLET DISPENSING PRODUCT

(71) Applicant: Scrub Daddy, Inc., Folcroft, PA (US)

(72) Inventors: John Edward Lee O'Brien, Garnet Valley, PA (US); Aaron C. Krause, Folcroft, PA (US); Aleksandrs Titovs, Folcroft, PA (US); Joe M. Vaccaro, West Chester, PA (US); Sheila Vaccaro, West Chester, PA (US)

(73) Assignee: SCRUB DADDY, INC., Pennsauken, NJ (US)

( * ) Notice: Subject to any disclaimer, the term of this patent is extended or adjusted under 35 U.S.C. 154(b) by 0 days.

(21) Appl. No.: 17/854,712

(22) Filed: Jun. 30, 2022

(65) Prior Publication Data

US 2023/0002142 A1 Jan. 5, 2023

Related U.S. Application Data

(60) Provisional application No. 63/218,176, filed on Jul. 2, 2021.

(51) Int. Cl.
*B65D 83/04* (2006.01)
*E03D 9/00* (2006.01)

(52) U.S. Cl.
CPC ..... *B65D 83/0409* (2013.01); *E03D 9/005* (2013.01); *B65D 2583/049* (2013.01); *B65D 2583/0454* (2013.01); *B65D 2583/0459* (2013.01)

(58) Field of Classification Search
CPC ..... B65D 83/0409
See application file for complete search history.

(56) References Cited

U.S. PATENT DOCUMENTS

| | | | | |
|---|---|---|---|---|
| 5,753,289 | A | 5/1998 | Ness | |
| 6,814,212 | B1 | 11/2004 | Ebersole | |
| 7,661,532 | B2 * | 2/2010 | Conley | B65D 75/327 206/536 |
| 2005/0178779 | A1 | 8/2005 | Wood | |
| 2006/0124658 | A1 | 6/2006 | Coe et al. | |
| 2014/0299598 | A1 | 10/2014 | Irani et al. | |
| 2014/0339249 | A1 * | 11/2014 | Reddy | G16H 20/13 221/1 |
| 2016/0107820 | A1 * | 4/2016 | MacVittie | B65D 83/0454 221/13 |
| 2018/0263853 | A1 | 9/2018 | Yang | |

OTHER PUBLICATIONS

PCT/US2022/035747 International Search Report and Written Opinion dated Nov. 1, 2022.

* cited by examiner

*Primary Examiner* — Gene O Crawford
(74) *Attorney, Agent, or Firm* — Troutman Pepper Hamilton Sanders LLP

(57) ABSTRACT

A dispensing product for storing a plurality of cleaning product tablets and individually dispensing them on demand that has a carousel assembly, a base, a lid, and an advancement mechanism. The carousel assembly has a plurality of depressions sized and configured to receive tablets. The base is underneath the carousel assembly. The lid is on top of the carousel and contains an aperture sized and configured such that a tablet can be withdrawn through the aperture. The advancement mechanism is connected to the carousel assembly and advances the carousel assembly rotationally.

20 Claims, 9 Drawing Sheets

TABLET DISPENSING PRODUCT

CROSS-REFERENCE TO RELATED APPLICATIONS

This application claims the benefit of U.S. Provisional Application Ser. No. 63/218,176 filed Jul. 2, 2021, which is incorporated herein by reference in its entirety.

FIELD

The present subject matter relates generally to a tablet dispensing product and, more particularly, to a dissolvable toilet tablet dispensing product.

BACKGROUND

Ideally, toilet cleaning products, or any cleaning product, are stored close to where they will be used. For toilet cleaners, cleaning products should be stored close to or inside the bathroom. Bathrooms are often small spaces with little storage space. Cleaning products and their storage containers should be small enough to fit in a bathroom. In addition, they should be visually appealing if they are stored in view of people who enter the bathroom.

Some cleaning products are dissolvable tablets. Dissolvable tablets, as their name suggests, dissolve when exposed to water. This can be problematic in a bathroom because bathrooms are often moist environments and prone to splashes of water, both of which may cause the dissolvable tablets to dissolve. Dissolvable cleaning tablets should be protected from a moist and wet environment.

Many people would prefer to not have to touch a toilet cleaning tablet or even a toilet cleaning tablet storage product. Toilet cleaning tablets should be stored such that a user need not touch the toilet cleaning tablet or its storage product to use the toilet cleaning tablet.

Cleaning products and their storage containers can be expensive. In addition, one-time-use products can be wasteful. When one-time-use products are necessary, it is often desirable that the product is recyclable. A storage container for dissolvable toilet tablets should be refillable and recyclable when possible.

SUMMARY

Some embodiments provide a dispensing product for storing dissolvable tablets and individually dispensing them on demand. In some embodiments, the dispensing product includes a carousel assembly, a base, a lid, and an advancement mechanism. In some embodiments, the carousel assembly has depressions sized and configured to receive a tablet. In some embodiments, the lid has an aperture sized and configured such that a tablet can be withdrawn through the aperture. In some embodiments, the advancement mechanism is connected to the carousel assembly and advances the carousel assembly rotationally.

In some embodiments, the carousel assembly has sliders to reduce friction between the carousel assembly and the base.

In some embodiments, the lid has an inner diameter that forms a hole at its center. In some embodiments, the dispensing product has a tablet wand holder. In some embodiments, the tablet wand holder has a hollow, cylindrical shape with a bottom surface and side walls. In some embodiments, the tablet wand holder is sized and configured to receive a tablet wand. In some embodiments, the tablet wand holder extends through the central hole in the lid.

In some embodiments, the advancement mechanism is located about an axle connected to the base. In some embodiments, the advancement mechanism includes a spring about the axle, a first gear about the axle and above the spring, a second gear about the axle and above the first gear, and a push button above the second gear. In some embodiments, a tablet wand holder is above and connected to the push button. In some embodiments, the push button comprises a third gear. In some embodiments, the first gear interfaces with the second gear and the third gear of the push button. In some embodiments, the spring provides resistance to depression of the push button. In some embodiments, depression of the tablet wand holder causes the push button to depress, the first gear to rotate, and the carousel assembly to rotationally advance.

In some embodiments, the base has a channel in which the sliders travel.

In some embodiments, the base has side walls and the lid is on top of the side walls.

In some embodiments, the lid is hingedly attached to the side walls of the base.

In some embodiments, the aperture of the lid is substantially in the shape of a wedge.

In some embodiments, the aperture of the lid is sized and configured such that only one of the depressions is uncovered by the lid.

In some embodiments, the advancement mechanism is configured to advance the carousel assembly a portion of a full rotation. In some embodiments, the portion is proportional to the number of depressions.

In some embodiments, the advancement mechanism includes retractable pen technology.

In some embodiments, the carousel assembly has a refill tray, a retaining tray, and a spinner tray. In some embodiments, the refill tray is on top of the retaining tray and the retaining tray is on top of and connected to the spinner tray. In some embodiments, the refill tray has depressions. In some embodiments, the spinner tray has sliders connected to its bottom portion to reduce friction between the spinner tray and a surface.

In some embodiments, the refill tray and the retaining tray are a single component.

In some embodiments, the retaining tray and the spinner tray are a single component.

In some embodiments, the retaining tray has guides extending perpendicularly from the retaining tray. In some embodiments, the guides are sized and configured to correspond to the depressions of the refill tray such that the refill tray is substantially held in place by the guides.

In some embodiments, the sliders are ball bearings.

In some embodiments, the dispensing product also includes tablets located in the depressions of the carousel assembly.

Some embodiments provide a toilet tablet cleaning system. In some embodiments, the toilet tablet cleaning system includes a dispensing product and a tablet wand.

In some embodiments, the toilet tablet cleaning system includes a refill tray. In some embodiments, the refill tray has depressions sized and configured to receive tablets.

Some embodiments provide a method of making a dispensing product for storing a plurality of cleaning product tablets and individually dispensing them on demand. In some embodiments, the method includes providing a carousel assembly having a plurality of depressions, providing a base, connecting the base underneath the carousel assembly, providing a lid, connecting the lid on top of the carousel assembly, providing an advancement mechanism, and connecting the advancement mechanism to the carousel assembly. In some embodiments, the plurality of depressions are sized and configured to receive a tablet. In some embodiments, the lid defines an aperture sized and configured such that the tablet can be withdrawn through the aperture. In some embodiments, the advancement mechanism advances the carousel assembly rotationally.

Additional features and advantages of the invention will be made apparent from the following detailed description of illustrative embodiments that proceed with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there are shown in the drawings embodiments that are presently preferred, it being understood, however, that the invention is not limited to the specific instrumentalities disclosed. Included in the drawings are the following Figures.

DETAILED DESCRIPTION

The present disclosure describes a product for storing dissolvable tablets, a system using a product for storing dissolvable tablets, and a method of making a product for storing dissolvable tablets.

Figure 1:
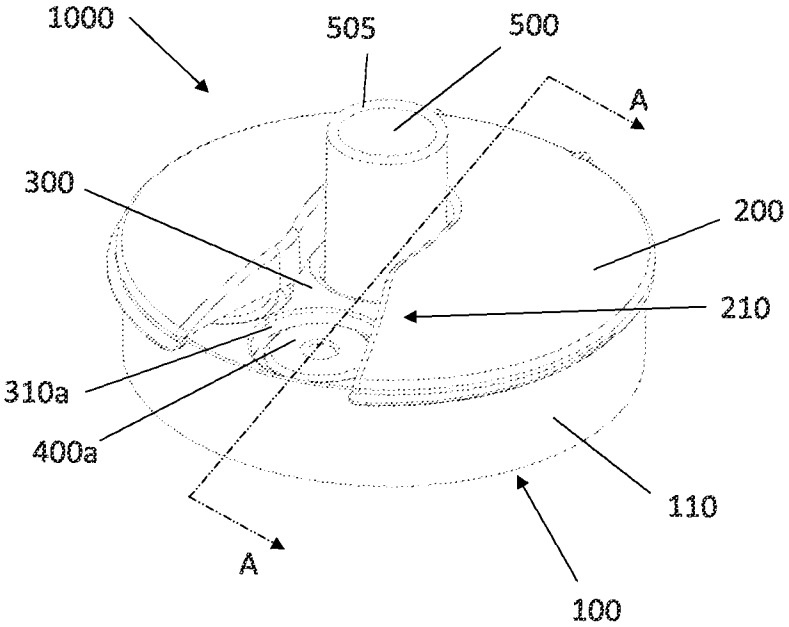
FIG. 1 is an perspective view of an embodiment of product for storing dissolvable tablets in its closed position.

FIG. 1 is an perspective view of an embodiment of product for storing dissolvable tablets 1000 in its closed position. In this embodiment, the product has a base 100 with side walls 110 and a lid 200. Inside the base 100 and underneath the lid 200 is a carousel assembly 300. The carousel assembly 300 has a plurality of depressions 310, each of which can hold a tablet 400. The lid 200 has an aperture 210 that reveals the carousel assembly 300 underneath. In this configuration, all but one of the depressions 310*a* is covered by the lid 200; the remaining depression 310*a* is left uncovered by the aperture 210 in the lid 200, and its tablet 400*a* is available to be selectively removed from or inserted into the carousel assembly 300 through the aperture 210. Inside the base 100, not shown, is an advancement mechanism 600. The advancement mechanism 600 causes the carousel assembly 300 to rotate about an axle. As the carousel assembly 300 rotates, the uncovered depression 310*a* will travel underneath the lid 200 while a covered depression 310*b* will move to the uncovered position under the aperture 210 of the lid 200. The product 1000 also has a tablet wand holder 500 that can hold a tablet wand 2100 that attaches to the tablets 400 for removal. The tablet wand holder 500 extends through the center of the lid 200.

Base

The base 100 provides a housing for the carousel assembly 300 and a mounting location for the lid 200.

In the embodiment shown in FIG. 1, the product 1000 has a base 100. A base 100 adds a finished look and structure.

In the embodiment shown in FIG. 1, the base 100 has side walls 110. Side walls 110 are not required. In some embodiments, the depressions 310 may be deep enough that the depressions 310 and the lid 200 adequately shield the tablets 400 without side walls 110.

Lid

The lid 200 shields the tablets 400 from moisture and water droplets. The lid 400 provides access to one tablet 400*a* in the carousel assembly 300.

Figure 2:
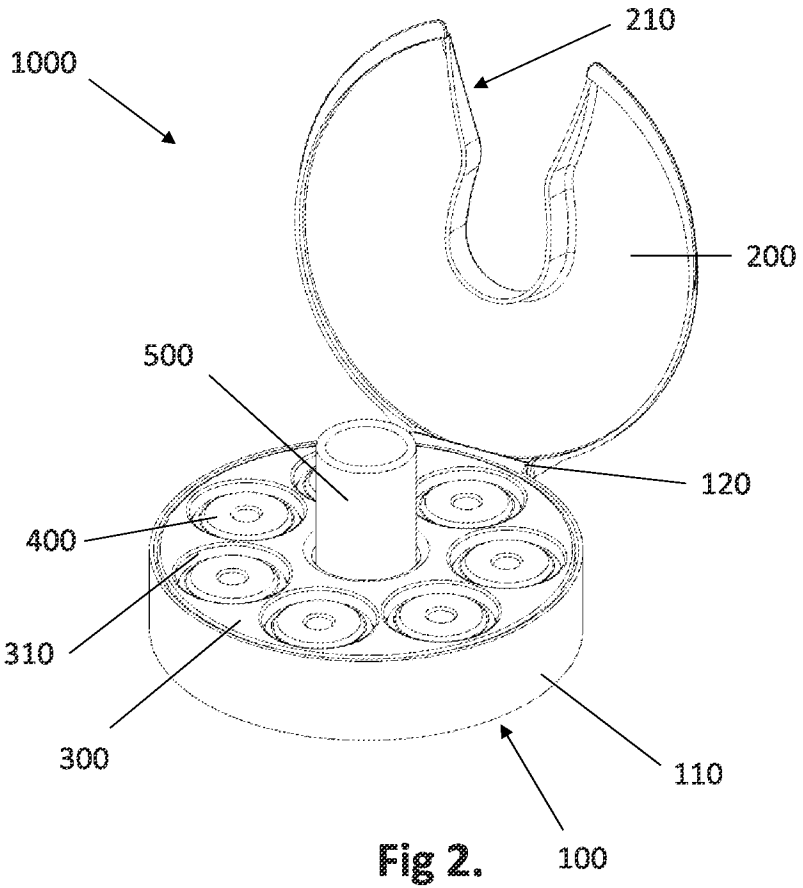
FIG. 2 is an perspective view of an embodiment of product for storing dissolvable tablets in its open position.

FIG. 2 is a perspective view of an embodiment of the dispensing product for dissolvable tablets 1000 in its open position. In the embodiment shown in FIG. 2, the lid 200 is attached to the base 100 via a hinge 120 at the side walls 110 of the base 100. However, the subject matter is not so limited. For example, in some embodiments, the lid 200 may engage on to the side walls 110, for example by click-fit or friction-fit, or simply rest on the side walls 110, or other arrangement whereby the sidewall 110 supports the lid.

The lid 200 has an aperture 210 large enough to uncover a depression 310*a* in the removal position and allow a tablet 400*a* to be withdrawn from the carousel assembly 300 through the aperture 210. The aperture 210 is small enough such that all of the other depressions 310 remain covered by the lid 200. In this configuration, all but one of the tablets 400 are shielded by the lid 200 from moisture and water droplets that can cause the tablets 400 to break down, and the uncovered tablet 400*a* is available for use.

In the embodiment shown in FIG. 2, the aperture 210 is wedge-shaped. The subject matter is not so limited. The aperture 210 can take an infinite number of shapes and sizes. In whatever shape and size, the aperture 210 may uncover only one depression 310*a* for access to tablet 400*a*, leaving the remaining depressions 310 and tablets 400, if present, covered by the lid 200, and provide enough clearance so that the tablet 400 can be removed from the carousel assembly 300 through the aperture 210. In some embodiments, the aperture 210 is complementary to the shape of the tablet. For example, rather than being a wedge shaped opening as shown in the figures, aperture 210 could be round, like the tablets.

Carousel Assembly

The carousel assembly 300 defines a plurality of depressions 310 for holding the tablets 400 and rotates underneath the lid 200. The carousel assembly 300 may have sliders 350 on the bottom portion of it to reduce friction to ease rotation.

In the embodiment shown in FIG. 2, the carousel assembly 300 has seven depressions 310. The subject matter is not so limited. The carousel assembly 300 may have more or less than seven depressions 310. In a preferred embodiment, the carousel assembly 300 has six depressions 310.

In the embodiment shown in FIG. 2, the depressions 310 are deeper than the tablets 400 are tall so that the tablets 400 sit within the carousel assembly 300 and do not extend past the top surface of the carousel assembly 300. However, the subject matter is not so limited. For example, in some embodiments, the depressions 310 may be shallower than the height of the tablets 400 such that the tablets 400 partially extend out from the depressions 310. In other embodiments, the depressions 310 may be equally as deep as the tablets 400 are tall.

In the embodiment shown in FIG. 2, the depressions 310 are round and receive disc-shaped tablets 400. However, the subject matter is not so limited. The depressions 310 can be configured to received tablets 400 of many shapes and sizes including in the shape of a sphere, a cylinder, an ellipsoid, a cube, a cuboid, and others. Those skilled in the art will understand that substitutions are possible here without departing from the subject matter herein.

In the embodiment shown in FIG. 2, the carousel assembly 300 has sliders 350 that reduce friction between the carousel assembly 300 and the base 100. The sliders 350 may be pads, ball bearings, wheels, or similar.

The carousel assembly 300 may be a single component assembly or a multi-piece assembly. In a single piece assembly, the top surface of the carousel assembly 300 has depressions 310 for holding tablets 400. The bottom portion of the carousel assembly 300 has sliders 350 that reduce friction between the carousel assembly 300 and the surface upon which it sits.

Figure 3:
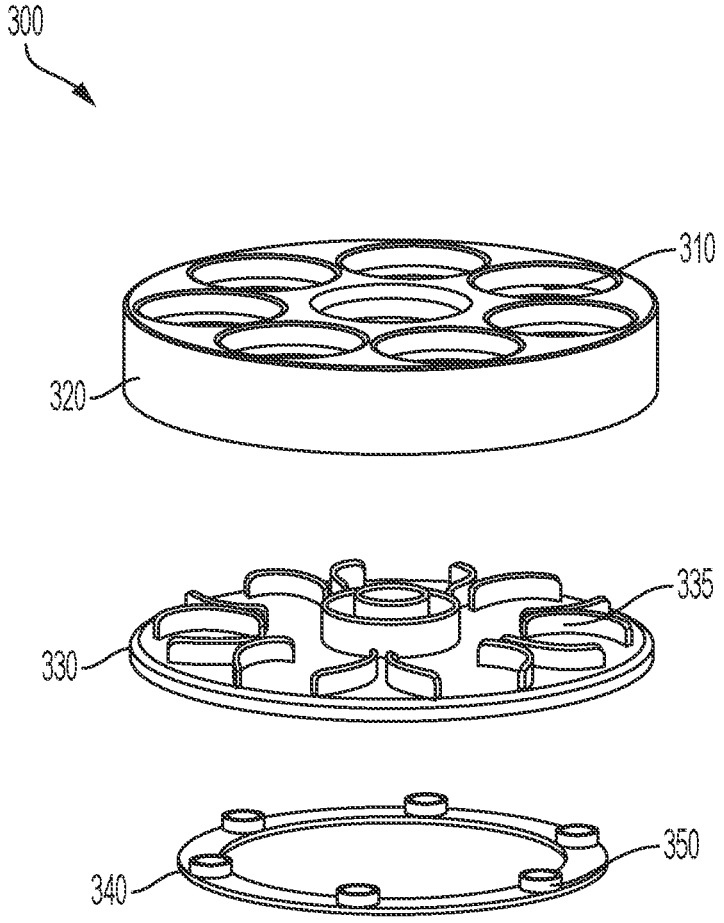
FIG. 3 is an exploded view of an embodiment of a multi-piece carousel assembly.

FIG. 3 is an exploded view of an embodiment of a multi-piece carousel assembly 300. In the embodiment shown in FIG. 3, the carousel assembly 300 includes a refill tray 320, a retaining tray 330, and a spinner tray 340. In this embodiment, the refill tray 320 contains depressions 310 for holding tablets 400. The refill tray 320 is located on top of the retaining tray 330. The retaining tray 330 interfaces with the refill tray 320 so that the refill tray 320 rotates with the other pieces of the carousel assembly 300. The retaining tray 330 is connected to and located on top of the spinner tray 340. The spinner tray 340 facilitates rotation because it has sliders 350 to reduce friction between the carousel assembly 300 and the base 100.

Figure 4:
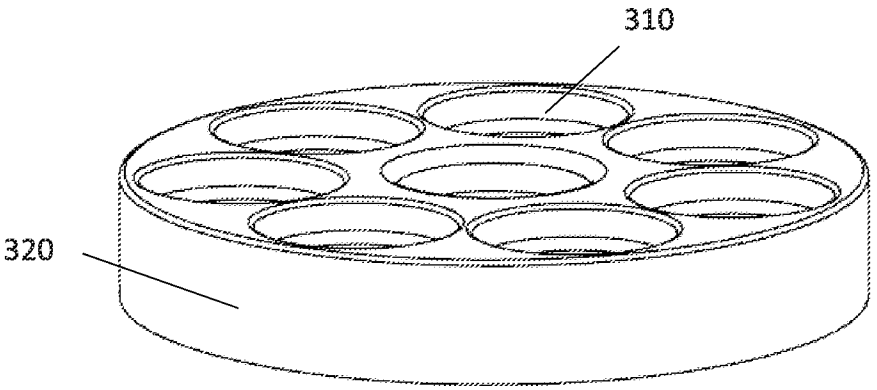
FIG. 4 is an perspective view of a refill tray.

FIG. 4 is a perspective view of a refill tray 320. In some embodiments, the refill tray 320 is made of recyclable material. In those embodiments, when all the tablets 400 are removed, the refill tray 320 can be removed from the product 1000 and recycled. A new refill tray 320 can then be inserted.

As shown in FIG. 3, in some embodiments, the retaining tray 330 has guides 335 engaged with the refill tray. As shown, these guides may be aligned with the depressions 310 of the refill tray 320 such that the refill tray 320 rotates with the other pieces of the carousel assembly 300. In the embodiment shown in FIG. 3, the guides 335 are in the shape of arcs. However, the subject matter is not so limited. The guides 335 may correspond with the shape of the depressions 310 on the refill tray 320. For example, in some embodiments the depressions 310 may be in the shape of a cube and the guides 335 may be linear.

In the embodiment shown in FIG. 3, the spinner tray 340 is in the shape of a ring having an inner diameter and an outer diameter. In this embodiment, the sliders 350 are ball bearings in equally spaced holes in the spinner tray 340. Ball bearings maintain a smooth rotation of the carousel assembly 300. In some embodiments, the ball bearings may rotate within channels on the underside of the carousel assembly 300 and on the top surface of the base 100. Friction reducing pads, felt, wheels, or other items may be used to aid rotation.

Figure 5:
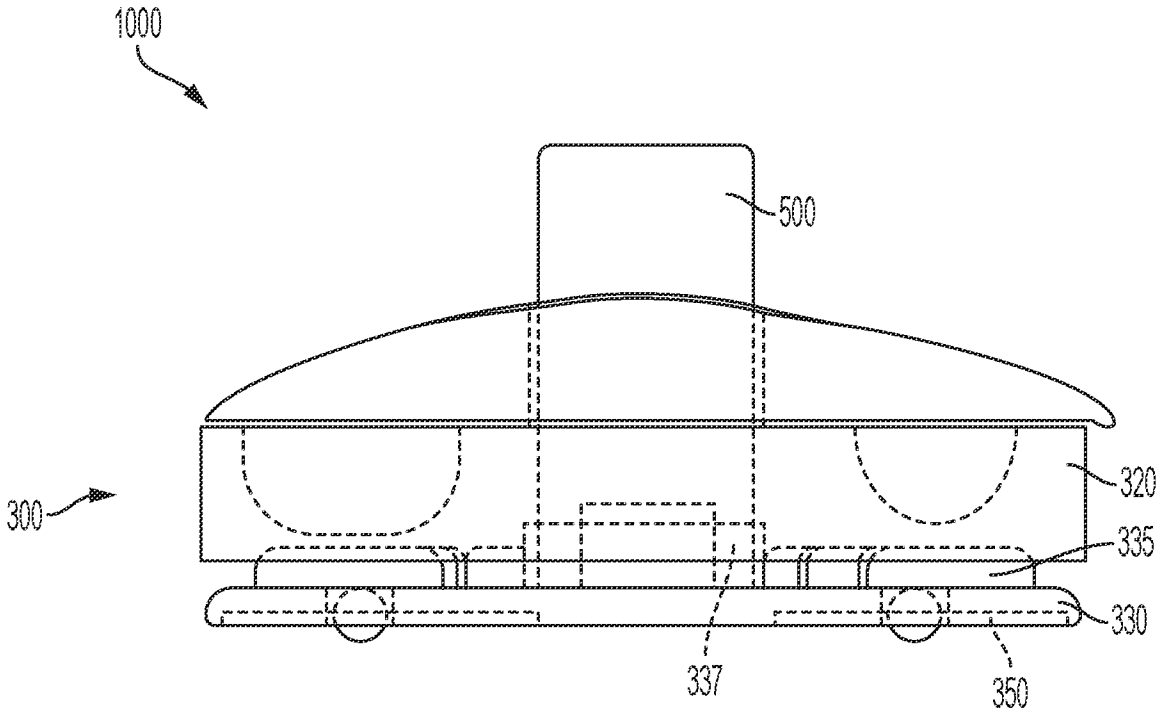
FIG. 5 is a side view of an embodiment of a product for storing dissolvable tablets shown without a base.

FIG. 5 is a side view of an embodiment of a product for storing dissolvable toilet tablets 1000 shown without a base. In this embodiment, the carousel assembly 300 is a multi-piece assembly. In this embodiment, the spinner tray 350 engages the underneath of the retaining tray 330 so as to move as a single piece. The engagement may be by click fit, friction fit, or other means. The refill tray 320 sits on top of the retaining tray 330 and is held in place by guides 335.

Other multi-piece carousel assembly embodiments 300 are possible. For example, in some embodiments, the refill tray 320 and the retaining tray 330 may be a single piece. In other embodiments, the retaining tray 330 and the spinner tray 350 may be a single piece.

Advancement Mechanism

The advancement mechanism 600 rotates the carousel assembly 300 under the lid 200.

The advancement mechanism 600 is attached to the carousel assembly 300 and rotates the carousel assembly 300 under the lid 200. In the embodiment in FIG. 1, the advancement mechanism 600 is within the side walls 110.

In some embodiments, the advancement mechanism 600 rotates the carousel assembly 300 a predetermined amount. The predetermined amount may be proportional to the number of depressions 310 in the carousel assembly 300. For example, if there are six depressions 310 in the carousel assembly 300, the predetermined amount may be ⅙ of a full rotation. In that embodiment, every time the advancement mechanism 300 is engaged, it will rotate the carousel assembly 300 ⅙ a rotation, which will move the uncovered depression 310*a* under the lid 200 and bring a covered depression 310 under the aperture 210 of the lid 200 to the uncovered position (corresponding to 310*a*).

In the preferred embodiment, the advancement mechanism utilizes retractable pen technology, but the subject matter herein is not so limited. The advancement mechanism 600 can utilize a motor, a dial that is moved along by a user to rotates the carousel assembly 300 or a ratchet system. Those skilled in the art will understand that other embodiments are possible.

Figure 6A:
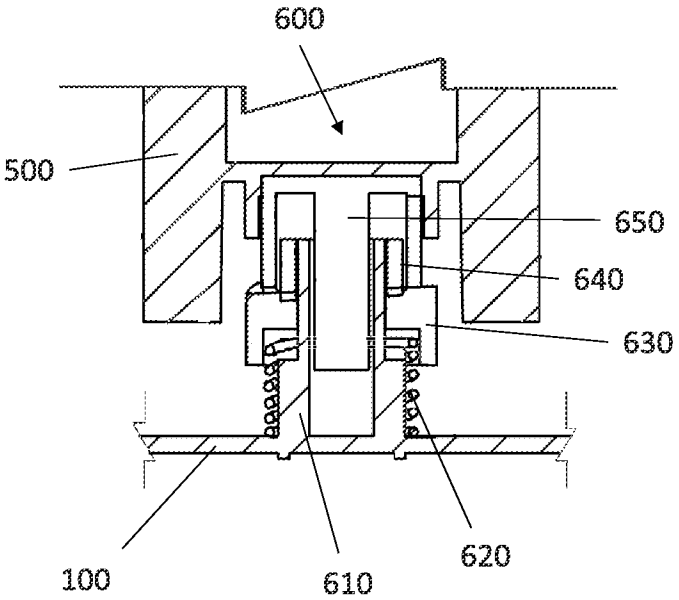
FIG. 6A is a close-up view of an embodiment of an advancement mechanism of FIG. 6 with the carousel assembly not shown.
Figure 6:
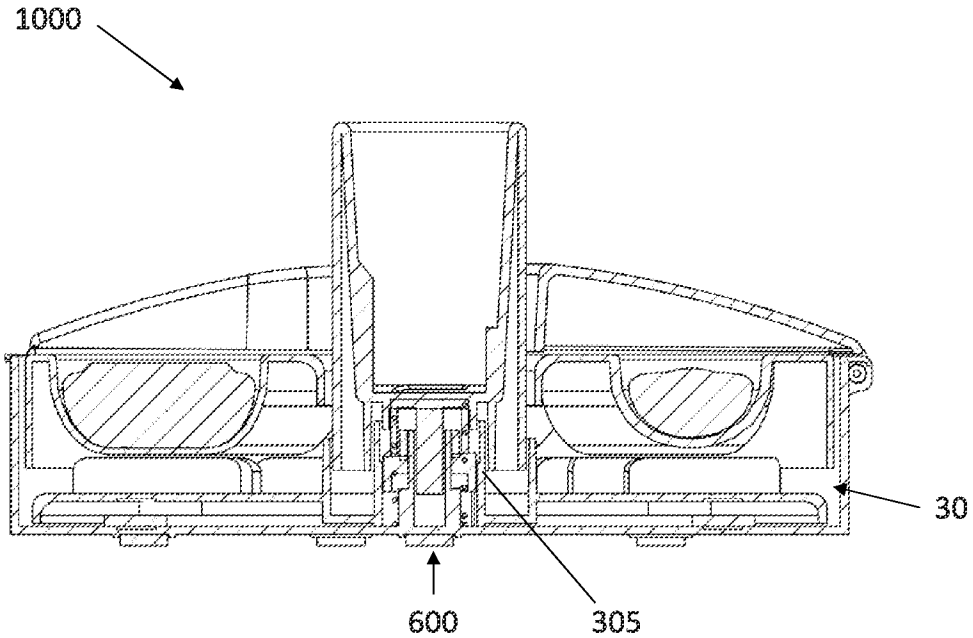
FIG. 6 is a cross-sectional view of an embodiment of a product for storing dissolvable tablets.

FIG. 6 is cross-sectional view A-A of FIG. 1. The embodiment of FIG. 6 utilizes a retractable pen technology as the advancement mechanism 600. In this embodiment, the carousel assembly 300 has an inner diameter 305 through which the advancement mechanism 600 extends.

FIG. 6A is a close-up view of an embodiment of an advancement mechanism 600 of FIG. 6 with the carousel assembly 300 not shown. The advancement mechanism can be any mechanism that causes the carousel to rotate, and preferably by a predetermined amount corresponding to the size of the tablet. In some embodiments the advancement mechanism is intended to be activated by linear motion transmitted by a tablet wand, wherein the linear motion is translated into rotational movement. This can be accomplished in any suitable way, such as the combination of gears shows in the figures, or other suitable means. In this embodiment, the advancement mechanism 600 includes an axle 610, a spring 620, a first gear 630, a second gear 640, and a push button 650. The axle 610 is attached to the center of the base 100. In other embodiments, the base 100 and axle 610 are one piece. The axle 610 extends through the inner diameter 305 of the carousel assembly 300, as shown in FIG. 6. Returning to FIG. 6A, a spring 620, a first gear 630, and a second gear 640 are placed on the axle 610. The first gear 620 connects the carousel assembly 300 to the advancement mechanism 600. The spring 610 is located closest to the base 100. The first gear 630 is located on top of the spring 620 and under the second gear 640. The first gear 630 and the second gear 640 interface with each other. The push button 650 is located on top of the second gear 640 and interfaces with the first gear 640. The push button 650 has a third gear 651 that interfaces with the first gear 640. In this configuration, when the push button 650 is depressed, the spring 620 is depressed, the first gear 630 rotates, and the carousel assembly 300 rotationally advances. As shown in FIG. 6A, in some embodiments, the push button 650 may be attached to the tablet wand holder 500.

Figure 6B:
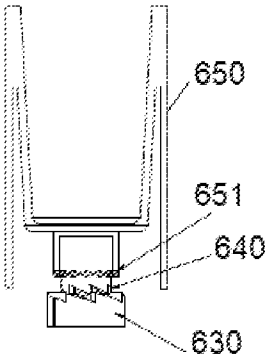
FIG. 6B is a close-up view of select elements of an embodiment of an advancement mechanism.

FIG. 6B is a close-up view of select elements of an embodiment of an advancement mechanism 600.

Figure 7:
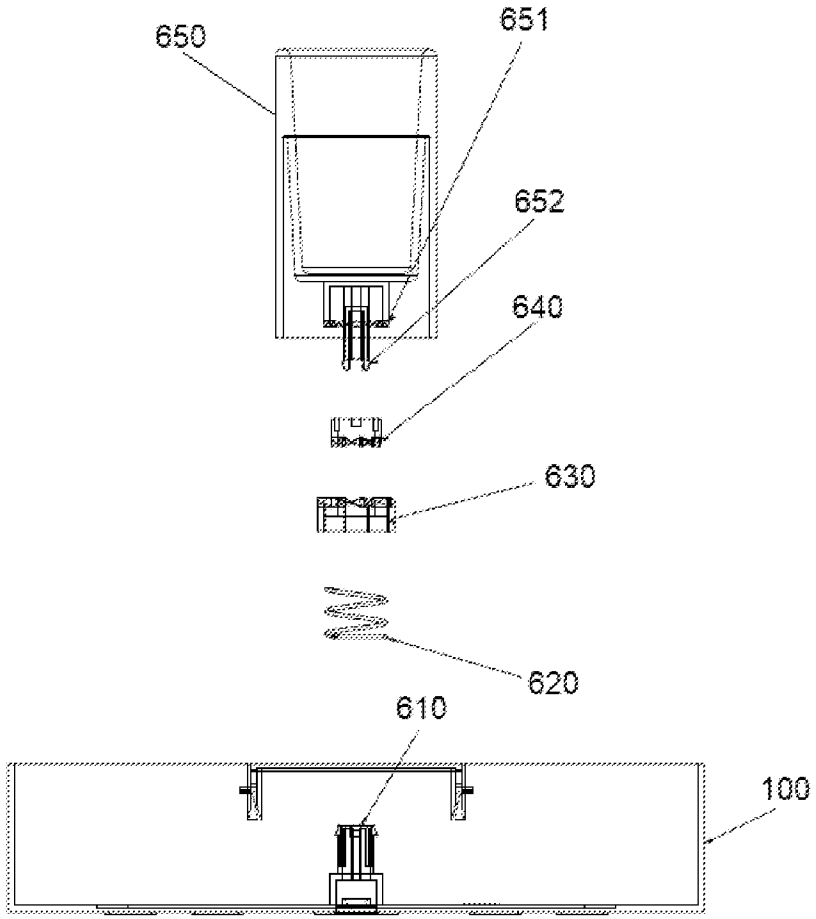
FIG. 7 is an exploded cross-sectional view of an embodiment of an advancement mechanism.

FIG. 7 is an exploded cross-sectional view of an embodiment of an advancement mechanism 600. In this embodiment, the second gear 640 is a lock gear that attaches to the axle 610 and does not move; it does not rotate or move vertically. In some embodiments, male and female clips and slots fix the second gear 640 to the axle 610. The second gear 640 has angled teeth. At rest, the first gear 630 interfaces with the angled teeth of the second gear 640. As such, at rest, the first gear 630 will be held in place by the second gear 640.

In this embodiment, the first gear 630 has female (flat) sides that interface with male clips of the carousel assembly 300 (not shown). Because of this orientation, the first gear 630 and the carousel assembly 300 will rotate together.

In this embodiment, the push button 650 is connected to the underside of a tablet wand holder 500. There is a push gear 651 on the push button 650. When the push button 650 is pressed, the spring 620 will depress, and the push gear 651 will cause the first gear 620 to slightly depress to travel past the tips of the second gear 640 and rotate, freeing the first gear 620 from its interface with the second gear's 640 angled teeth and positioning the first gear 620 beneath the next angled tooth of the second gear 640. When the push button 650 is released, the spring 620 will release and move the first gear 620 back up into the second gear's 640 angled teeth. Because the first gear 630 was moved beneath the next angled tooth of the second gear 640 when the push bottom 650 was pressed, the first gear 630 will move along the angle of the next angled tooth of the second gear 640, causing the first gear 630 and carousel assembly 300 to rotationally advance.

In some embodiments, the push button 650 has clips 652 that extend into a hollow axle 610 and prevent the push button 650 from lifting up and out of the axle 610.

Tablet Wand Holder

Referring again to FIG. 1, in this embodiment, a product for storing dissolvable tablets 1000 has a tablet wand holder 500. Some cleaning tablets 400 are configured to be used with a tablet wand 2100. Therefore, it is helpful that a product for storing dissolvable tablets 1000 contains a location for also storing a tablet wand 2100.

In the embodiment shown in FIG. 1, the tablet wand holder 500 is cylindrical in shape, having a bottom surface and side walls 505. However, the subject matter herein is not so limited. For example, the tablet holder 500 can have a square or rectangular cross-section with side walls 505. Those skilled in the art understand that other configurations are possible without departing from the subject matter herein.

Referring again to FIG. 5, in some embodiments, the tablet wand holder 500 connects to the retaining tray 330. In some embodiments, the retaining tray 330 has protrusions 337 that extend perpendicularly from the retaining tray 330 to receive the tablet wand holder 500.

In the preferred embodiment, the tablet wand holder 500 interfaces with the advancement mechanism 600. For example, the tablet wand holder 500 may interface with an advancement mechanism 600 that utilizes retractable pen technology, as shown in FIG. 6A. In those embodiments, the bottom of the wand holder 500 may be connected to the top of the push button 650. In this configuration, a user may press the wand holder 500 down causing the push button 650 to depress and the carousel assembly 300 to rotationally advance, as described above. In the preferred embodiment, the tablet wand holder 500 is pressed down using a tablet wand 2100.

Toilet Tablet Cleaning System

Figure 8:
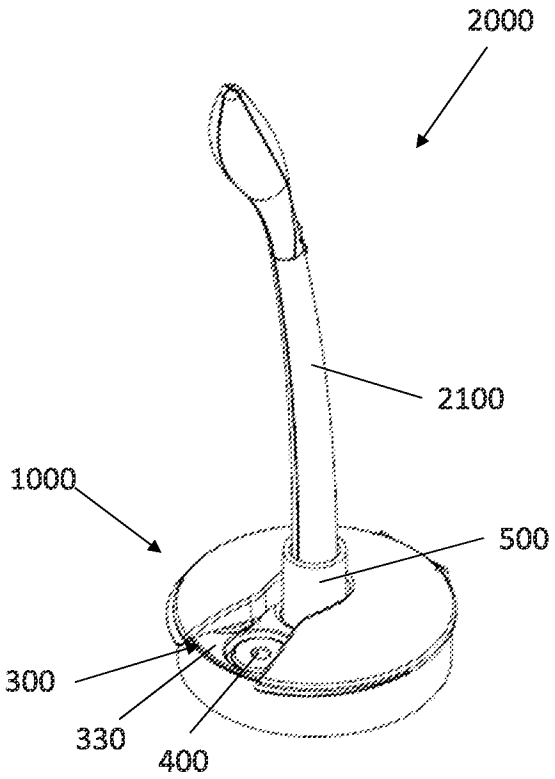
FIG. 8 is an perspective view of a toilet tablet cleaning system.

FIG. 8 is a perspective view of a toilet tablet cleaning system 2000. The toilet tablet cleaning system 2000 includes a product for storing dissolvable tablets 1000, as discussed above. In some embodiments, the system 2000 includes a tablet wand 2100 than can be used to attach to a dissolvable toilet tablet 400. In some embodiments, the tablet wand 2100 can be stored in the tablet wand holder 500. In some embodiments, the product for storing dissolvable tablets 1000 includes a multi-piece carousel assembly 300. In such embodiments, the system 2000 may also include a refill tray 320. In some embodiments, the system 2000 includes tablets 400. In some embodiments, the tablets 400 are dissolvable. In the preferred embodiment, the tablets 400 are dissolvable tablets 400 for cleaning toilets. This configuration allows the product for storing dissolvable tablets 1000 to be reused when all the tablets 400 have been used. A user can lift the lid 200, remove the refill tray 330, and recycle it. The user can then place a new refill tray 330, full of tablets 400, on the retaining tray 340 and close the lid 200.

The toilet tablet cleaning system 2000 allows a user to attach a dissolvable toilet tablet 400 to a tablet wand 2100 without directly touching the tablet 400 or the product for storing dissolvable tablets 1000. In some embodiments, the user may obtain a product for storing dissolvable tablets 1000. In some embodiments, the user may press the tablet wand holder 500 down with the tablet wand 2100 causing the advancement mechanism 600 to rotate the carousel assembly 300. In some embodiments, one of the depressions 310 will be uncovered through the aperture 210 of the lid 200. In some embodiments, the user may repeatedly press down the tablet wand holder 500 with the tablet wand 2100 until a depression 310 holding a tablet 400*a* is uncovered through the aperture 210 in the lid 200. In some embodiments, the user may remove the tablet wand 2100 from the tablet wand holder 500. In some embodiments, the user may contact the uncovered tablet 400*a* with the tablet wand 2100 to connect the uncovered tablet 400*a* to the tablet wand 2100. In some embodiments, the user may remove the uncovered tablet 400*a* from the product for storing dissolvable tables 1000 through the aperture 210 in the lid 200.

Method of Making

Figure 9:
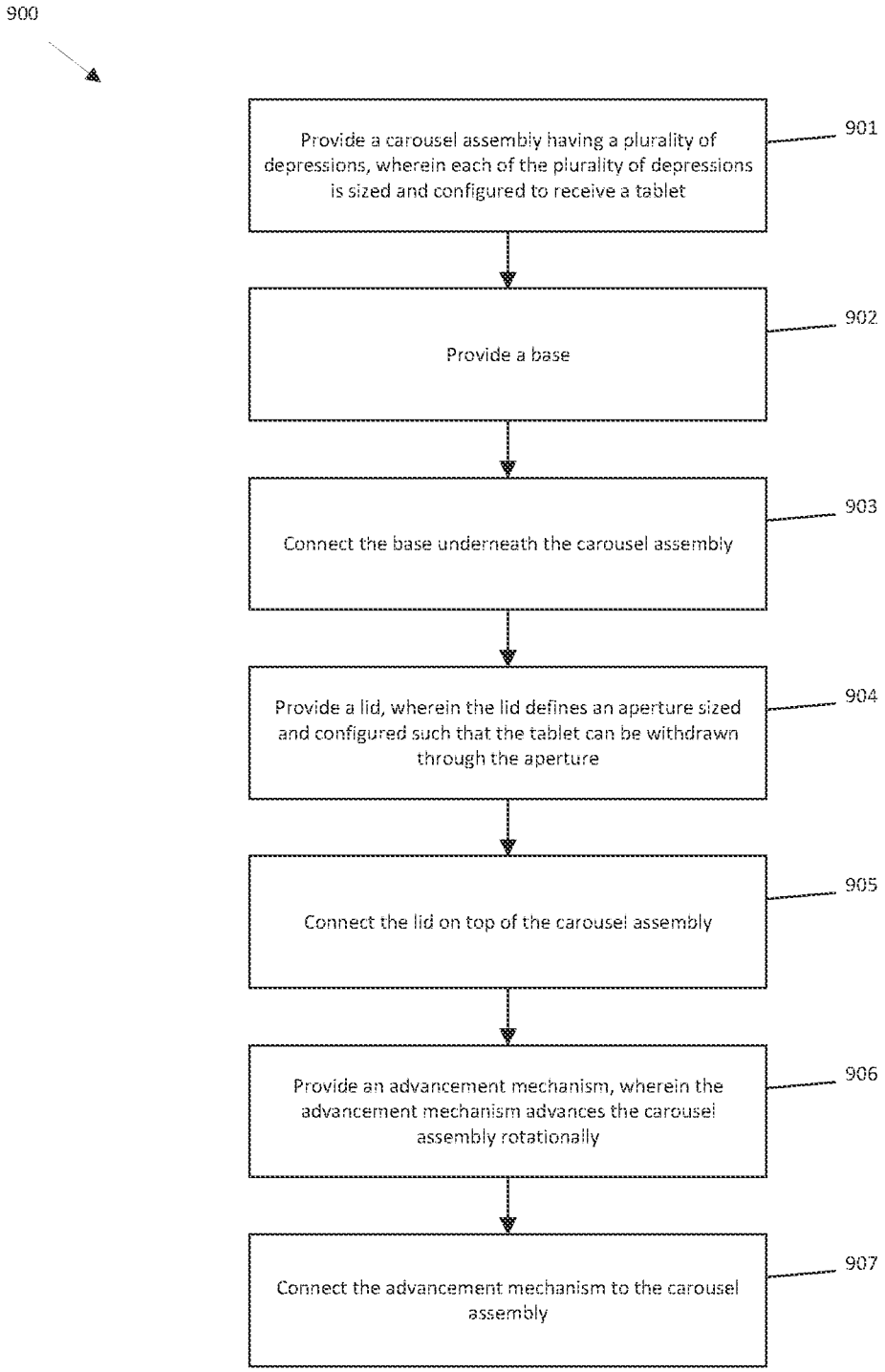
FIG. 9 is a flow chart depicting a method of making a dispensing product for storing a plurality of cleaning product tablets and individually dispensing them on demand.

FIG. 9 is a flow chart depicting a method of making a product for storing dissolvable tablets 1000. In some embodiments, the method includes providing a carousel assembly having a plurality of depressions at Step 901, providing a base at Step 902, connecting the base underneath the carousel assembly at Step 903, providing a lid at Step 904, connecting the lid on top of the carousel assembly at Step 905, providing an advancement mechanism at Step 906, and connecting the advancement mechanism to the carousel assembly at Step 907. In some embodiments, the plurality of depressions of the carousel assembly are sized and configured to receive a tablet. In some embodiments, the lid defines an aperture sized and configured such that the tablet can be withdrawn through the aperture. In some embodiments, the advancement mechanism advances the carousel assembly rotationally.

The elements of the figures are not exclusive. Other embodiments may be derived in accordance with the principles of the invention to accomplish the same objectives. Although this invention has been described with reference to particular embodiments, it is to be understood that the embodiments and variations shown and described herein are for illustration purposes only. Modifications to the current design may be implemented by those skilled in the art, without departing from the scope of the invention.

We claim:

1. A toilet tablet cleaning system comprising:

a dispensing product for storing a plurality of cleaning product tablets and individually dispensing them on demand, the dispensing product comprising:

a carousel assembly having:

a retaining tray, and a spinner tray attached to an underside of the retaining tray, a base underneath the carousel assembly;

a lid on top of the carousel assembly, the lid having an inner diameter forming a hole, the lid defining an aperture sized and configured such that a tablet can be withdrawn through the aperture, a tablet wand holder extending through the hole in the lid, the tablet wand holder having a substantially cylindrical shape having a bottom surface and side walls, wherein the tablet wand holder is sized and configured to receive a tablet wand, and an advancement mechanism connected to the carousel assembly, wherein the advancement mechanism advances the carousel assembly rotationally about an axis; and a tablet wand in the tablet wand holder.

2. The toilet tablet cleaning system of claim 1, further comprising:

a refill tray having a plurality of depressions, each of the plurality of depressions sized and configured to receive a tablet.

3. The toilet tablet cleaning system of claim 2, wherein the retaining tray further comprises a plurality of guides extending perpendicularly from the retaining tray, the plurality of guides sized and configured to correspond with the plurality of depressions such that the refill tray is substantially held in place by the guides.

4. A product for storing a plurality of cleaning product tablets and individually dispensing them on demand, the product comprising:

a carousel assembly having a plurality of depressions, each of the plurality of depressions sized and configured to receive a tablet;

a base underneath the carousel assembly;

a lid on top of the carousel assembly, the lid defining an aperture sized and configured such that one of the plurality of cleaning product tablets can be withdrawn through the aperture; and an advancement mechanism connected to the carousel assembly, wherein the advancement mechanism advances the carousel assembly rotationally, wherein the carousel assembly is a multi-piece assembly comprising:

a refill tray having the plurality of depressions;

a retaining tray underneath the refill tray and on top of a spinner tray; and the spinner tray underneath the retaining tray and attached to the advancement mechanism and to the retaining tray, wherein the one or more sliders are connected to a bottom portion of the carousel assembly at a bottom portion of the spinner tray such that the one or more sliders reduce friction between the spinner tray and the base.

5. The product of claim 4, wherein the refill tray and the retaining tray are a single component.

6. The product of claim 4, wherein the retaining tray and the spinner tray are a single component.

7. The product of claim 4, wherein the retaining tray further comprises a plurality of guides extending perpendicularly from the retaining tray, the plurality of guides sized and configured to correspond with the plurality of depressions such that the refill tray is substantially held in place by the guides.

8. The product of claim 4, wherein the one or more sliders of the carousel assembly are ball bearings.

9. The product of claim 4, wherein the lid further comprises an inner diameter defining a central hole passing through the lid at its center, the product further comprising:

a tablet wand holder extending through the hole in the lid, the tablet wand holder having a substantially cylindrical shape having a bottom surface and side walls, wherein the tablet wand holder is sized and configured to receive a tablet wand.

10. A product for storing a plurality of cleaning product tablets and individually dispensing them on demand, the product comprising:

a carousel assembly having a plurality of depressions, each of the plurality of depressions sized and configured to receive a tablet;

a base underneath the carousel assembly;

a lid on top of the carousel assembly, the lid defining an aperture sized and configured such that one of the plurality of cleaning product tablets can be withdrawn through the aperture; and an advancement mechanism connected to the carousel assembly, wherein the advancement mechanism advances the carousel assembly rotationally, wherein the carousel assembly further comprises one or more sliders connected to a bottom portion of the carousel assembly, wherein the one or more sliders reduce friction between the carousel assembly and the base.

11. The product of claim 10, further comprising:

the lid further comprises an inner diameter defining a central hole passing through the lid at its center; and a tablet wand holder extending through the central hole in the lid, the tablet wand holder having a hollow, substantially cylindrical shape having a bottom surface and side walls, wherein the tablet wand holder is sized and configured to receive a tablet wand.

12. The product of claim 11, wherein the advancement mechanism further comprises:

a spring around an axle extending perpendicularly from the base, a first gear around the axle, above the spring, and connected to an inner diameter of the carousel assembly;

a second gear above the first gear and interfaces with the first gear; and a push button above the second gear and attached to a bottom portion of the tablet wand holder, wherein the push button comprises a third gear that interfaces with the first gear, wherein upon depression of the tablet wand holder, the push button depresses the spring, and the first gear rotates, and the carousel assembly rotationally advances by virtue of its attachment to the advancement mechanism.

13. The product of claim 10, wherein the base further comprises a channel in which the one or more sliders travel.

14. The product of claim 10, wherein the base further comprises side walls, wherein the lid is on top of the side walls.

15. The product of claim 14, wherein the lid is hingedly attached to the side walls.

16. The product of claim 10, wherein the aperture of the lid is substantially in the shape of a wedge.

17. The product of claim 10, wherein the aperture of the lid is sized and configured such that only one of the plurality of depressions is uncovered by the lid.

18. The product of claim 10, wherein the advancement mechanism is configured to advance the carousel assembly a portion of a full rotation, wherein the portion is proportional to a number of depressions of the plurality of depressions.

19. The product for storing dissolvable tablets of claim 10, wherein the lid further comprises an inner diameter defining a central hole passing through the lid at its center, and the product further comprises:

a tablet wand holder extending through the central hole in the lid, wherein the tablet wand holder is sized and configured to receive a tablet wand, wherein depression of the tablet wand holder causes the advancement mechanism to advance the carousel assembly.

20. The product of claim 10, further comprising:

one or more tablets, each of the one or more tablets located in one of the plurality of depressions in the carousel assembly.

* * * * *